US005975319A

United States Patent [19]

Carlile, Jr.

[11] Patent Number: 5,975,319

[45] Date of Patent: Nov. 2, 1999

[54] SLACK PULLING CARRIAGE

[75] Inventor: James Quentin Carlile, Jr., Drain, Oreg.

[73] Assignee: Richard Van Damme, Eugene, Oreg.

[21] Appl. No.: 09/025,425

[22] Filed: Feb. 18, 1998

Related U.S. Application Data

[60] Provisional application No. 60/038,876, Feb. 18, 1997.

[51] Int. Cl.[6] ..... B66C 21/00

[52] U.S. Cl. ..... 212/99; 212/97; 212/110

[58] Field of Search ..... 212/87–93, 97–105, 212/110, 111

[56] References Cited

U.S. PATENT DOCUMENTS

| | | | |
|---|---|---|---|
| 879,113 | 2/1908 | Miller et al. | 212/89 |
| 1,509,716 | 9/1924 | Daniel | 212/89 |
| 1,817,264 | 8/1931 | Nickerson | 212/91 |
| 2,173,127 | 9/1939 | Nelson | 212/98 |
| 3,247,933 | 4/1966 | Hanna | 212/92 |
| 3,407,833 | 10/1968 | Read | 212/99 |
| 4,238,038 | 12/1980 | Fikse et al. | 212/89 |
| 4,453,642 | 6/1984 | Myhre | 212/89 |
| 4,454,951 | 6/1984 | Kuehn . | |
| 4,456,131 | 6/1984 | Kuehn . | |
| 4,515,281 | 5/1985 | Maki | 212/89 |

*Primary Examiner*—Thomas J. Brahan
*Attorney, Agent, or Firm*—Steven J. Adamson

[57] ABSTRACT

A slack pulling carriage having a skidding line drum arrangement that achieves efficient and accurate movement of the carriage along the skidding line. The drum arrangement is preferably configured such that the skidding line loops around at least approximately 180 degrees of the circumference of the drum. A hydraulic driving system, a multiple speed motor and locking clamps are also disclosed.

30 Claims, 4 Drawing Sheets

SLACK PULLING CARRIAGE

RELATED APPLICATION

This application claims the benefit of U.S. Provisional Application No. 60/038,876, filed Feb. 18, 1997, and having the same title and inventor as above.

FIELD OF THE INVENTION

The present invention relates to slack pulling carriages and more specifically to improving the performance of such carriages.

BACKGROUND OF THE INVENTION

Slack pulling carriages are generally known in the art. Referring to FIG. 1, a diagram of a slack pulling carriage 10 in accordance with the present invention is shown. Though FIG. 1 illustrates a slack pulling carriage incorporating the present invention, there are aspects of the present slack pulling carriage that are common to all such slack pulling carriages and some of these aspects are now discussed as background to facilitate a better understand the present invention.

A slack pulling carriage generally employs a sky line that is steadfastly mounted to a tree stump or other mount at a distal end (not shown) and to a yarder 15 at a landing 25. The carriage 10 moves freely along the sky line 20 by virtue of suitable pulley arrangements 17. A clamp 18 is also provided for securely holding the carriage at a desired position along the sky line. A skidding line 30 feeds through a drum arrangement (not shown) within the carriage and has one end 32 affixed at landing 25 and another end 34 which descends from the carriage. End 32 is attached to a mechanical driver for retracting (or letting out the skidding line) and end 34 is the end to which cut logs are attached for removal from the forest.

The carriage also includes a clamp (not shown) adjacent the drum arrangement for securely clamping the carriage to the skidding line. When this clamp is closed about the skidding line (and the sky line clamp is open), movement of the skidding line causes the carriage to move along sky line 20. When the skidding line clamp is released (and the sky line clamp is closed), movement of the skidding line causes end 34 to be raised or lowered, hence, for example, permitting a log to be lifted from the forest floor.

Carriage 10 also includes a motor for driving the drum arrangement. The combination of the motor and drum arrangement permits movement of the carriage along the skidding line (with both clamps open). The motor, drum arrangement and clamps may be actuated by remote control (often using radio frequency control signals).

With respect to prior art slack pulling carriages, these carriages utilize drum arrangements that are disadvantageous for various reasons (discussed below), particularly in view of current forest practices. For example, one known drum arrangement that utilizes a plurality of drums with the skidding line threaded intricately through the drums. This multiple drum arrangement provides a high degree of friction between the carriage and line which in turn permits secure movement of the line relative to the carriage. The multiple drum arrangement, however, is disadvantageous, in that it (1) induces an undesirable amount of stress on the skidding line and drum components and (2) is large, relatively expensive and heavy (requiring more stringent skyline anchoring and more energy to move). Furthermore, machines with multiple drums may be inappropriately large for current forest practices which are directed to the harvest of second or third growth forests, which provide considerably smaller logs than first growth or virgin forests.

Another known slack pulling carriage utilizes a more simplified drum arrangement in which a single drum is provided. In this arrangement, the skidding line is positioned between the drum and two sheaves. An actuator causes the sheaves to contact the skidding line and push the skidding line into contact with a portion of the drum. A disadvantage of this arrangement, however, is that a drum/skidding line region of sufficient length to achieve efficient and accurate movement of the carriage (i.e., no slipping on the line) is not achieved. Slipping on the line may also tend to disadvantageously accelerate deterioration of the line.

SUMMARY OF THE INVENTION

Accordingly, it is an object of the present invention to provide a slack pulling carriage that incorporates a minimalistic drum arrangement that achieves sufficient skidding line friction for accurate and efficient movement of the carriage.

It is another object of the present invention to provide a slack pulling carriage that incorporates a single skidding line drum and is configured such that the skidding line loops around the drum.

It is another object of the present invention to provide a slack pulling carriage that incorporates a hydraulic engine/motor.

It is another object of the present invention to provide a slack pulling carriage that has a multiple speed motor.

It is also an object of the present invention to provide a slack pulling carriage that incorporates an improved clamping mechanism.

These and related objects of the present invention are achieved by use of a slack pulling carriage as described herein.

The attainment of the foregoing advantages and features of the invention should be more readily apparent to those skilled in the art, after review of the following more detailed description of the invention taken together with the drawings.

DETAILED DESCRIPTION

Figure 1:
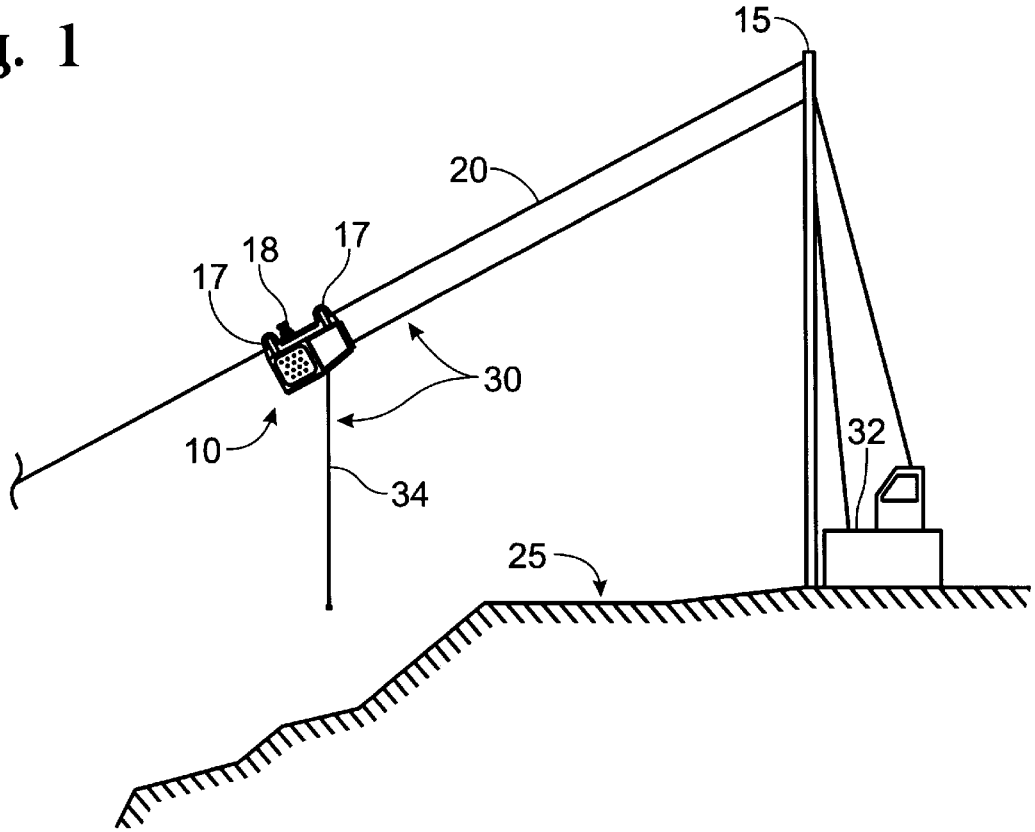
FIG. 1 is a diagram of a slack pulling carriage in accordance with the present invention and its associated lines.

Referring further to FIG. 1, the carriage 10 preferably includes an engine generally positioned in the aft section of a carriage and the drum arrangement generally positioned in the fore section of the carriage. A hydraulic drive mechanism which permits the drum to be driven by the engine is also provided.

Figure 2:
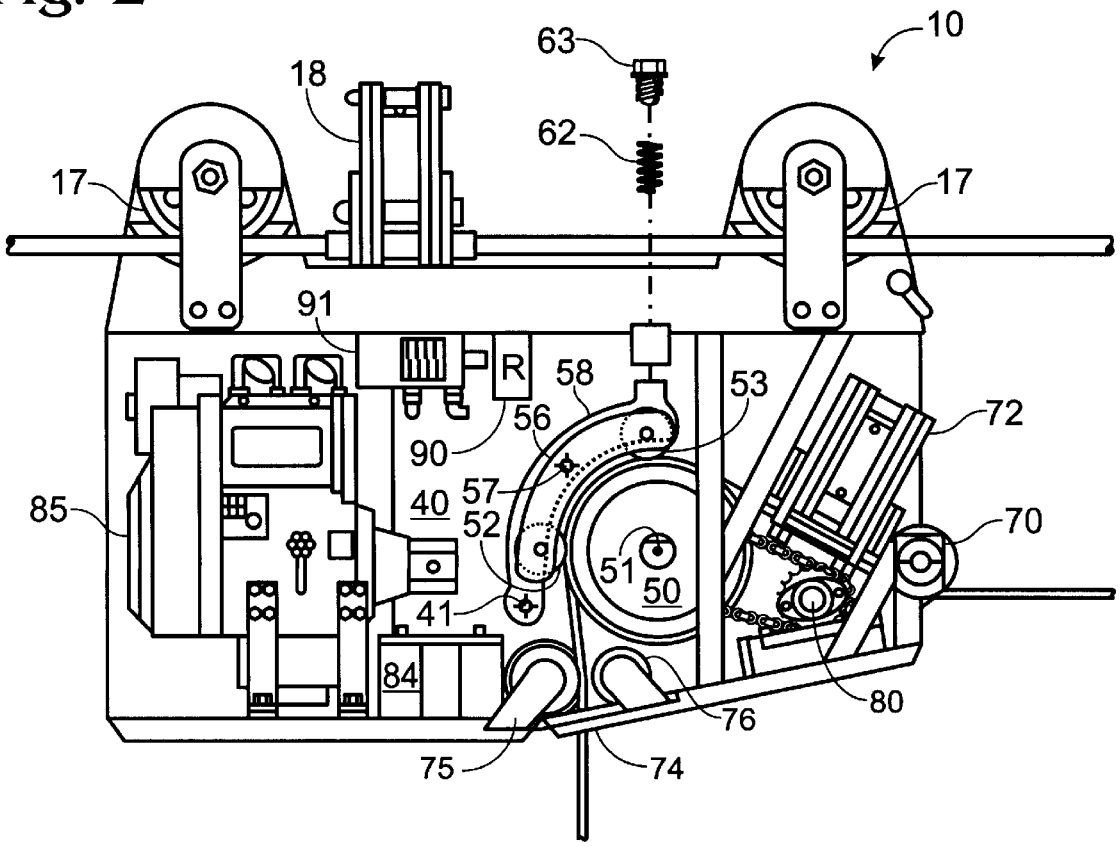
FIG. 2 is a side view (with a cover removed) of a slack pulling carriage in accordance with the present invention.

Referring to FIG. 2, a side view of the slack pulling carriage of FIG. 1 in accordance with the present invention (with a side cover removed such that the engine and drum arrangement are visible) is shown. The manner in which the sky line 20 mounts to pulleys 17 and is feed through clamp 18 is shown. The entry of skidding line 30 into and out of the carriage is also shown.

In the embodiment illustrated in FIG. 2, the drum arrangement includes a single driving drum 50 about which is looped skidding line 30. As will be demonstrated in more detail below, the skidding line in the embodiment of FIG. 2 preferably loops around the drum at least one complete revolution and then descends out the bottom of carriage 10. By looping skidding line 30 around drum 50, sufficient friction (e.g., sufficient skidding line-drum contact area) for efficient and accurate movement of the carriage relative to the skidding line is achieved. Furthermore, this design produces a minimal amount of mechanical/physical stress on the line or drum and achieves a lightweight, efficient, and potentially more affordable carriage 10. The design of carriage 10 is also well suited for harvesting smaller second growth trees.

Skidding line 30 is fed through an input or fair lead sheave 70 which functions to provide low friction positioning of skidding line 30 in a desired location. The skidding line then feeds through clamp 72 (described in more detail below) and loops around drum 50.

Two tension wheels 52,53 (shown also in FIGS. 3–4) are biased against line 30 as it propagates around drum 50. The tension wheels ensure proper positioning of the skidding line relative to the drum and protect against an undesirable overlap of the line.

The tension wheels are mounted to an inner tension arm 56 which is pivotally coupled (about pivot point 57) to an outer tension arm 58. The outer tension arm is pivotally mounted (about pivot point 41) to the carriage frame (generally represented by reference numeral 40) and is biased towards drum 50 by tension spring 62 and tension plug 63 that are also coupled to the frame. It should be recognized that a hydraulic cylinder may be utilized in place of plug 63. Spring 62 biases outer arm 58 toward the drum, which in turn causes pivot 57 to exert approximately equal force through inner arm 56 onto the tension wheels 52,53. Plug 63 permits an operator to adjust the amount of tension exerted by spring 62 on the outer tension arm. Plug 63 also permits release of the tension arms 56,58 such that they may pivot backwards about point 41 to provide ample room for the threading of skidding line 30 around drum 50.

After looping around drum 50, skidding line 30 exits carriage 10 at a port 74 adjacent output fair lead sheaves 75,76. The output sheaves function to maintain line 30 in a position generally centered within port 74, particularly when the line is pulled at different angles to retrieve a log.

Drum 50 is preferably driven by a hydraulic motor 80, though mechanical driving mechanisms are also contemplated. Hydraulic motor 80 preferably drives drum 50 by a chain 81 which encircles a gear sprocket (not shown) that is mounted about the drum pivot point 51. Motor 80 is in turn driven by hydraulic pressure generated by engine 85. The engine may be any of various models and in one embodiment is a 20 HP 2 cylinder air cooled diesel of the type made by Lombardini. A hydraulic pump 86 (or pumps as discussed below, see FIG. 5) are mounted to the engine. Pressure built up in the pump is transferred through a manifold 91 (discussed with reference to FIG. 5) to motor 80 and clamps 18,72. A battery 84 is also preferably provided for ignition of engine 85 and to power radio 90 (R), amongst other known reasons.

Operation of the carriage is preferably achieved by a remote control radio signal device 90 such as that made by Remote Safety Systems of Salem, Oreg. The radio 90 controls the manifold which in turn controls motor and clamp operation.

Figure 3:
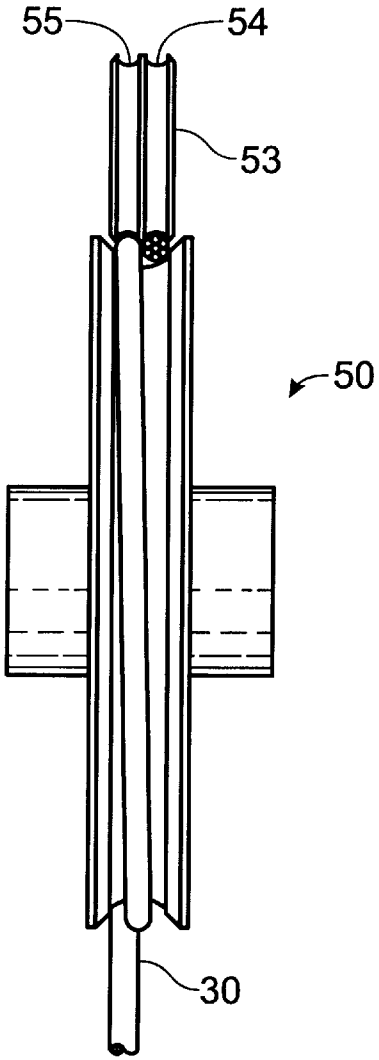
FIG. 3 is a diagram of a front view of a drum and skidding line arrangement in accordance with the present invention.

Referring to FIG. 3, a front view of drum 50, tension wheel 52 and skidding line 30 (shown in partial cross-section) in accordance with the present invention is shown. FIG. 3 illustrates one manner of looping line 30 around drum 50. Tension wheel 53 is configured to have two radial grooves 54,55 which respectively hold the initial and second wrap of line 20 against drum 50 in a manner that prevents destructive overlap of the initial and second wraps and facilitates frictional contact between the line and drum.

Figure 4B:
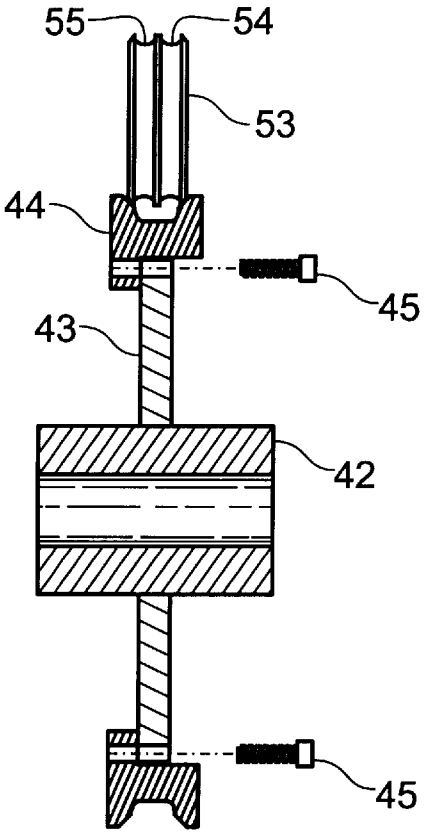
FIGS. 4A–4B are a side view and a cross-sectional view, respectively, of a skidding line drum in accordance with the present invention.
Figure 4A:
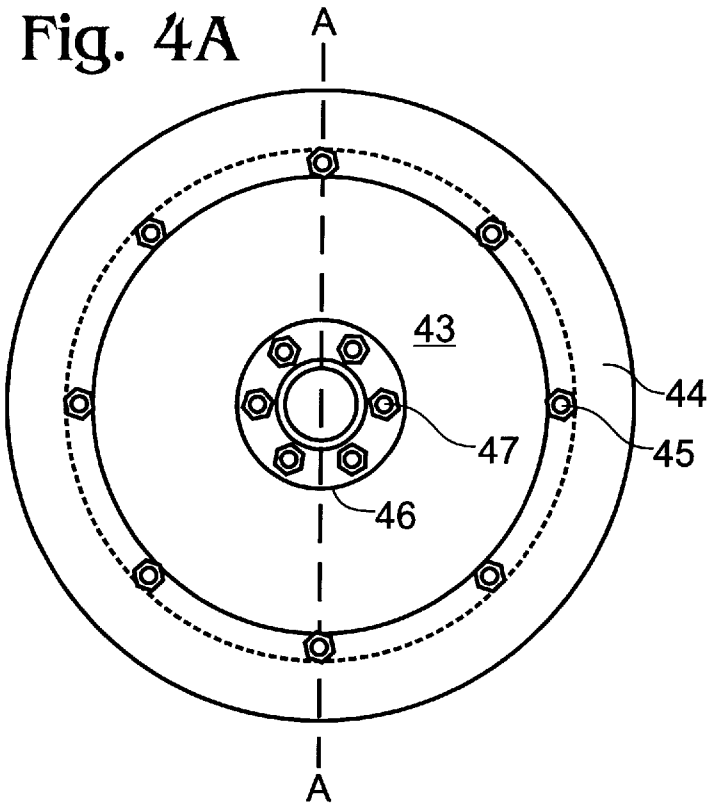

Referring to FIGS. 4A–4B, a side and a cross-sectional front view of drum 50 in accordance with the present invention are respectively shown. Drum 50 may be constructed in a plurality of manners. In a preferred embodiment illustrated in FIGS. 4A–4B, the drum includes a Shelby tube 42 that is cut to an appropriate length and welded within a ¾" circular metal plate 43. A flanged ring 44 is heat shrunk onto circular plate 43 and fastened by bolts 45. FIG. 4A also illustrates a bearing cover plate 46 fastened by bolts 47. The position of tension wheel 53 relative to flange ring 44 is shown in FIG. 4B. It should be recognized that the size of drum 50 and related components may vary based on the intended capabilities and size of the carriage in which they are incorporated.

Figure 5:
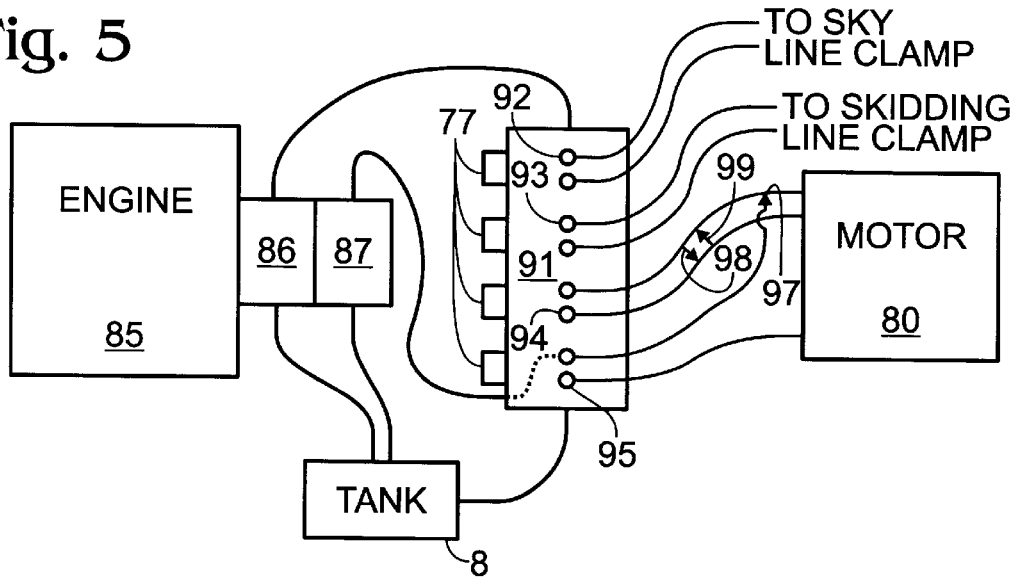
FIG. 5 is a diagram of the hydraulic power system for a slack pulling carriage in accordance with the present invention.

Referring to FIG. 5, a diagram of a hydraulic drive network in accordance with the present invention is shown. First and second hydraulic pumps 86,87 are mounted to engine 85. The output of pump 86 is fed to the first three ports 92–94 of a four port manifold 91 and the output of pump 87 is fed to the fourth port 95. The first port 92 provides the supply and return hydraulic pressure to sky line clamp 18, while the second port 93 provides the supply and return hydraulic pressure to skidding line clamp 72. The third port and fourth ports 94,95 provide hydraulic pressure supply and return to motor 80. The provision of pump 87 with its output fed through manifold 91 to port 95 and motor 80 effectively makes motor 80 a two speed motor. The first speed is generated by pressure from pump 86 and the second speed is generated by pressure from both pumps 86 and 87. The supply line of port 95 is coupled to that of port 94 by a check value 97 which permits one way flow.

Fluid on each of the plurality of return lines is output to tank 68 for subsequent uptake by pumps 86,87. A plurality of conventional control valves 77 are provided (one each) for each of the ports 92–95.

The supply and return lines of third port 94 preferably have interconnecting check valves 98,99 of a kind generally known in the art. The provision of these valves permit drum 50 to rotate freely (when the skidding line clamp is open), thereby permitting the skidding line to be retracted or let out from the landing while the carriage remains in place. The manifold is preferably made of an aluminum block through which the appropriate openings are bored.

Figure 6B:
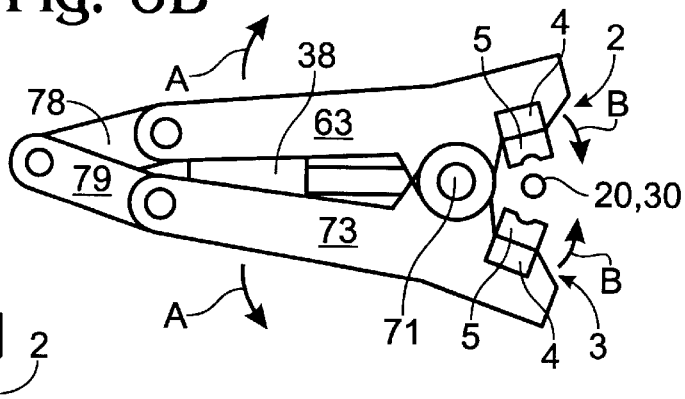
FIGS. 6A–C are views illustrating aspects of a clamp in accordance with the present invention.
Figure 6A:
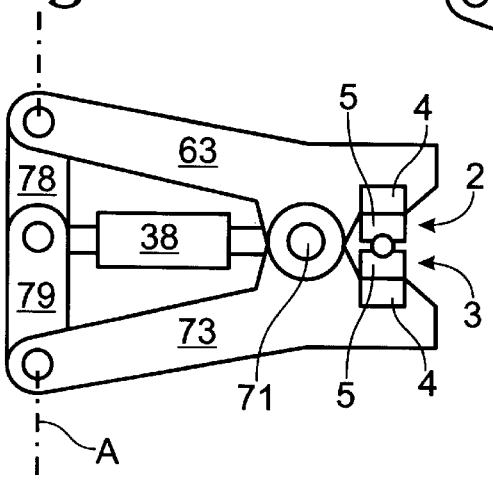

Referring to FIGS. 6A–6B, open and closed views of a clamp 18,72 as it extends in a plane perpendicular to sky line 20 or skidding line 30, i.e., front or back views from the perspective of FIG. 2, in accordance with the present invention are shown. FIG. 6A illustrates the closed position (also shown in FIG. 2), while FIG. 3 illustrates the open or released position. Each clamp has a primary pivot axis 71 about which symmetric clamp members 63,73, are pivotally mounted. Clamping elements 2,3 are mounted at one end of members 63,73, respectively, while two stabilizing links 78,79 are pivotally coupled at the other ends. Two sets of clamp members 63,73 and stabilizing links 78,79 are provided for each clamp, on the front and back sides thereof. The clamping elements 2,3 run between the sets of clamp members 63,73 and along line 20,30 (as shown in FIG. 2). Pressure on members 63,73 in the direction of arrows A (for the released clamp of FIG. 6B), causes the clamp to move to the closed position, shown in FIG. 6A. The pressure is preferably exerted by a longitudinally disposed hydraulic cylinder 38 that is powered via manifold 91. In the contracted position (FIG. 6A), the hydraulic cylinder preferably pulls the stabilizing links a few degrees past center, towards the clamping elements (the center is indicated by line A), for enhanced locking.

Figure 6C:
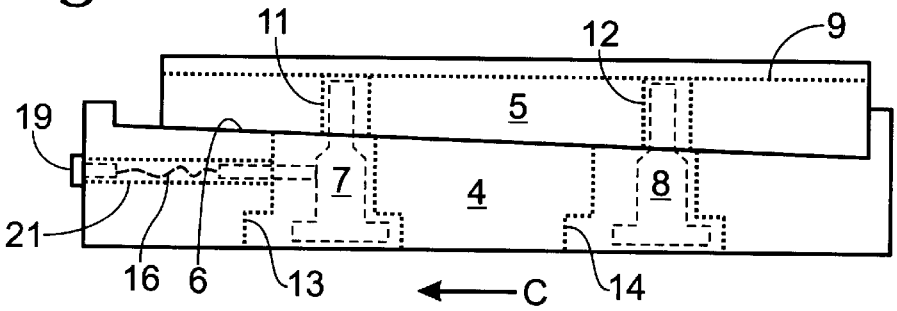

Referring to FIG. 6C, a lateral view of a representative clamping element 2 or 3 is accordance with the present invention is shown. Each clamping element 2,3 preferably includes a carriage 4, a pad 5 configured for movement along a top surface 6 of carriage 4, a plurality of recesses 11–14 as shown in dashed lines, shoulder bolts 7,8 which hold the pad within the carriage, and a bias spring 16. Pad 5 and carriage 4 are also shown in FIGS. 6A–6B.

Each pad 5 is configured to have a center groove 9 configured to receive line 20,30 and two recesses 11,12. The deepest part of groove 9 is shown in dashed line. The carriage 4 is machined or otherwise formed to have two recesses 13,14 which align with recesses 11,12, though they are larger, particularly along the direction of movement of the pad.

The shoulder bolts 7,8 are mounted through recesses 13,14 into recesses 11,12. A spring 16 (with plug 19) is mounted through a hole 21 formed in carriage 4 to bias bolt 7 and thereby pad 5 towards the position shown in FIG. 6C (opposite arrow C).

A clamp 18,72 is preferably positioned about line 20,30 such that the weight of slack pulling carriage 10 (for the sky line) or the force exerted by the line, for example, while the skidding line is being retracted, causes the pad 5 to move in the direction of arrow C when the clamp is closed about the subject line. Since the inward surface 6 of carriage 4 is sloped gradually upward along the direction of arrow C, the pad(s) 5 are compressed about line 20,30 serving to securely lock the carriage to the line. This arrangement provides secure clamping of the line, even in the event of a total loss of hydraulic pressure. When the clamp is released, spring 16 biases pad 5 back to its original position. While there are benefits to the pad arrangement of FIG. 6C, it should be recognized that other aspects of the present invention can be practiced with a clamp that does not have moving pads 5.

Figure 7:
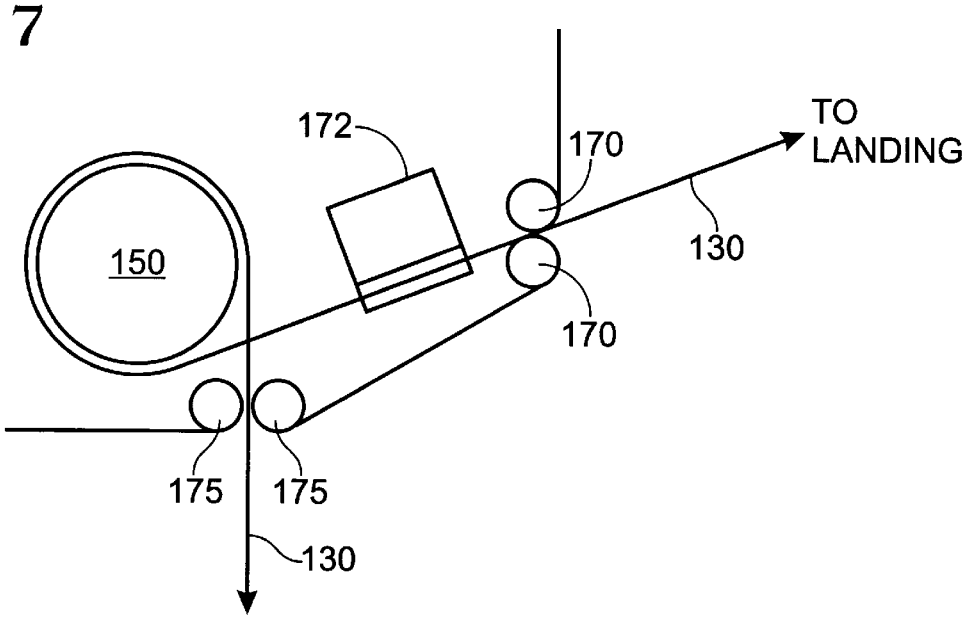
FIG. 7 is a side view of an alternative embodiment of a drum arrangement in accordance with the present invention.

Referring to FIG. 7, a diagram of an alternative embodiment of a drum arrangement in accordance with the present invention is shown. In the embodiment of FIG. 7, the skidding line 130 is fed through input sheaves 170, through clamp 172 and around drive 150 for a revolution of approximately 270 degrees before exiting through output sheaves 175. The components of FIG. 7 are analogous to the components of FIG. 2. It should be recognized that although only one loop around is shown in FIG. 7, the skidding line could be wrapped multiple times around drum 150.

Figure 8:
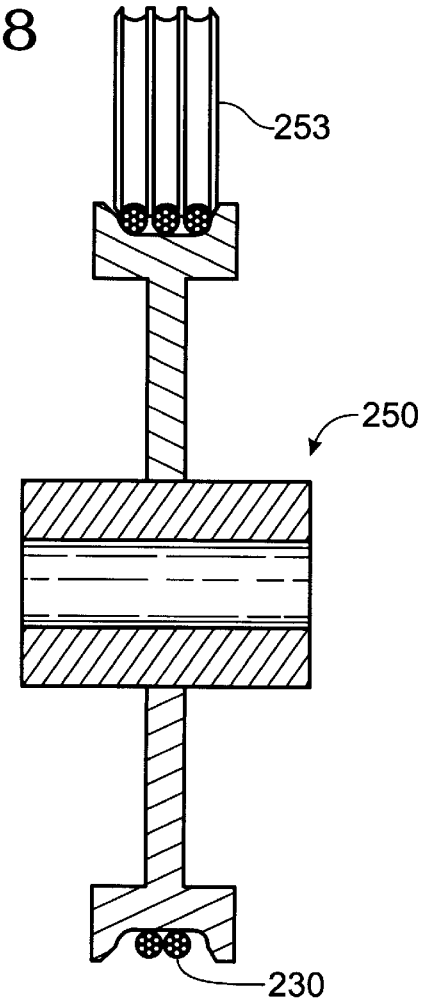
FIG. 8 is a cross-sectional view of an alternative embodiment of a drum arrangement in accordance with the present invention.

Referring to FIG. 8, a diagram of another alternative embodiment of a drum arrangement in accordance with the present invention is shown. FIG. 8 illustrates a cross-section of a drum 250 and tension wheel 253 arrangement in which the skidding line 230 is wrapped at least two times around drum 250. The components of FIG. 8 are analogous to the components of FIGS. 3–4.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A slack pulling carriage apparatus, comprising:

a frame;

a mechanism coupled to said frame that permits movement of said frame along a sky line;

a skidding line driving arrangement coupled to said frame that includes a singular skidding line driving drum that is arranged within said carriage such that in use a skidding line input to said carriage apparatus loops substantially about said singular driving drum and is output from said carriage apparatus, that skidding line not undergoing a deflection of more than approximately 120 degrees by another sheave; and a drive mechanism that drives said driving drum;

wherein said skidding line driving drum is configured within said carriage apparatus in such a manner that a skidding line is caused to contact at least approximately 270 degrees of a circumference of said driving drum when said drum is driving a skidding line, said contact at said singular driving drum being sufficient to achieve adequate friction for driving a skidding line within a compact skidding line driving arrangement.

2. The apparatus of claim 1, further comprising a least a first alignment sheave for positioning a skidding line for said driving drum, said alignment sheave being smaller than said driving drum and inducing a deflection of less than approximately 120 degrees in a skidding line.

3. The apparatus of claim 1, wherein said skidding line driving drum is configured within said carriage apparatus such that a skidding line for use therein loops around the driving drum such that a skidding line intersects itself in the general plane of the driving drum as seen from a perspective substantially perpendicular to said plane.

4. The apparatus of claim 1, wherein said skidding line driving drum is configured within said carriage apparatus in such a manner that a skidding line is caused to contact at least approximately 360 degrees of the circumference of said driving drum when said drum is driving a skidding line.

5. The apparatus of claim 1, wherein said driving drum is configured within said carriage apparatus in such a manner that a skidding line is caused to contact more than approximately 360 degrees but less than approximately 720 of the circumference of said driving drum when said drum is driving a skidding line.

6. The apparatus of claim 2, wherein said alignment sheave induces a deflection of less than approximately 90 degrees in a skidding line.

7. The apparatus of claim 1, wherein said skidding line driving drum is configured within said carriage apparatus in such a manner that a skidding line therein is caused to loop at least twice around said driving drum.

8. The apparatus of claim 1, further comprising a first clamping device for at least one of a skidding line and a sky line, said clamping device including a clamping force applying mechanism and first and second clamping members each having a clamping end, said first and second clamping members being pivotally coupled and arranged with said force applying mechanism such that the clamping ends apply equal and opposite force to a line provided therebetween for clamping.

9. The apparatus of claim 8, wherein said force applying mechanism is provided substantially between said point of pivotal coupling and a distal end of said members, opposite said clamping ends; and further comprising a linkage arrangement coupled to said distal ends and said force applying mechanism, said force applying mechanism moving said linkage arrangement into a position when clamping a line that requires application of a positive force to the linkage arrangement to release the linkage arrangement and release the clamping device.

10. The apparatus of claim 9, wherein said force applying mechanism applies a force in a direction substantially perpendicular to that of a line clamped by said clamping device.

11. The apparatus of claim 1, wherein said driving drum is arranged within said carriage apparatus such that downward force on said skidding line is borne substantially by said driving drum when in use.

12. The apparatus of claim 1, wherein said drive mechanism includes a multiple speed hydraulic motor.

13. A slack pulling carriage, comprising:

a frame;

a sky line clamping assembly coupled to said frame;

a skidding line clamping assembly coupled to said frame;

a skidding line driving arrangement coupled to said frame that includes a singular skidding line driving drum that has a planar surface area on each of its two faces that is at least approximately two times larger than a similar face of any other rotatable member in said carriage that contacts the skidding line; and a motorized drive mechanism that drives said drum;

wherein said skidding line driving drum is configured within said carriage apparatus in such a manner that a skidding line is caused to contact at least approximately 270 degrees of a circumference of said driving drum when said drum is driving a skidding line.

14. The apparatus of claim 13, wherein said other rotatable member is a sheave.

15. A slack pulling carriage, comprising:

a frame;

a sky line clamping assembly coupled to said frame;

a skidding line clamping assembly coupled to said frame;

a skidding line driving drum coupled to said frame; and a drive mechanism that drives said driving drum;

wherein at least one of said clamping assemblies includes a clamping force applying mechanism and first and second clamping members each having a clamping end, said first and second clamping members being pivotally coupled and arranged with said force applying mechanism such that the clamping ends apply equal and opposite force to a line provided therebetween for clamping.

16. The apparatus of claim 15, wherein said force applying mechanism is provided substantially between said point of pivotal coupling and a distal end of said members, opposite said clamping ends; and further comprising a linkage arrangement coupled to said distal ends and said force applying mechanism, said force applying mechanism moving said linkage arrangement into a position when clamping a line that requires application of a positive force to the linkage arrangement to release the linkage arrangement and release the clamping assembly.

17. The apparatus of claim 16, wherein said force applying mechanism applies a force in a direction substantially perpendicular to that of a line clamped by said clamping assembly.

18. The apparatus of claim 15, wherein said driving drum is configured within said carriage apparatus in such a manner that a skidding line is caused to contact at least approximately 270 degrees of a circumference of said driving drum when said drum is driving a skidding line.

19. The apparatus of claim 15, wherein said driving drum has a surface on each of its two faces that is at least approximately twice as large as any other rotatable sheave member in the carriage apparatus that contacts a skidding line in use.

20. The apparatus of claim 15, wherein said driving drum is arranged within said carriage apparatus such that downward force on said skidding line is borne substantially by said driving drum when in use.

21. The apparatus of claim 15, wherein no other rotatable member that contacts a skidding line when in use deflects that line by more than approximately 120 degrees.

22. A slack pulling carriage, comprising:

a frame;

a mechanism coupled to said frame that permits movement of said frame along a sky line;

a skidding line driving arrangement coupled to said frame that includes a singular skidding line driving drum that is arranged within said carriage such that in use a skidding line contact at least approximately 270 degrees of the circumference of the driving drum; and a motorized drive mechanism that drives said driving drum;

wherein said driving drum is arranged within said carriage apparatus such that downward force on said skidding line is borne substantially by said driving drum when in use.

23. The apparatus of claim 22, wherein said skidding line driving drum is configured within said carriage apparatus in such a manner that a skidding line is caused to contact at least approximately 360 degrees of the circumference of said driving drum when said drum is driving a skidding line.

24. The apparatus of claim 22, wherein said driving drum is configured within said carriage apparatus in such a manner that a skidding line is caused to contact more than approximately 360 degrees but less than approximately 720 of the circumference of said driving drum when said drum is driving a skidding line.

25. The apparatus of claim 22, further comprising a first clamping device for at least one of a skidding line and a sky line, said clamping device including a clamping force applying mechanism and first and second clamping members each having a clamping end, said first and second clamping members being pivotally coupled and arranged with said force applying mechanism such that the clamping ends apply equal and opposite force to a line provided therebetween for clamping.

26. The apparatus of claim 1, wherein said singular driving drum has a planar surface area on each of its two faces that is at least approximately two times larger than a similar face of any other rotatable member in said carriage that contacts the skidding line.

27. The apparatus of claim 13, wherein said skidding line driving drum is configured within said carriage apparatus such that a skidding line for use therein loops around the driving drum such that a skidding line intersects itself in the general plane of the driving drum as seen from a perspective substantially perpendicular to said plane.

28. The apparatus of claim 13, wherein said driving drum is configured within said carriage apparatus in such a manner that a skidding line is caused to contact more than approximately 360 degrees but less than approximately 720 of the circumference of said driving drum when said drum is driving a skidding line.

29. The apparatus of claim 13, further comprising a first clamping device for at least one of a skidding line and a sky line, said clamping device including a clamping force applying mechanism and first and second clamping members each having a clamping end, said first and second clamping members being pivotally coupled and arranged with said force applying mechanism such that the clamping ends apply equal and opposite force to a line provided therebetween for clamping.

30. The apparatus of claim 29, wherein said force applying mechanism is provided substantially between said point of pivotal coupling and a distal end of said members, opposite said clamping ends; and further comprising a linkage arrangement coupled to said distal ends and said force applying mechanism, said force applying mechanism moving said linkage arrangement into a position when clamping a line that requires application of a positive force to the linkage arrangement to release the linkage arrangement and release the clamping device.

* * * * *